United States Patent [19]

Sundovist

[11] Patent Number: 4,942,675

[45] Date of Patent: Jul. 24, 1990

[54] APPARATUS AND METHOD FOR REGULATING THE PROFILE OF A PAPER WEB PASSING OVER A YANKEE CYLINDER IN AN INTEGRATED IR-DRYER/YANKEE HOOD

[75] Inventor: Hans Sundqvist, Turku, Finland

[73] Assignee: Valmet Paper Machinery, Inc., Helsinki, Finland

[21] Appl. No.: 319,679

[22] Filed: Mar. 7, 1989

[30] Foreign Application Priority Data

Mar. 8, 1988 [FI] Finland ..... 881070

[51] Int. Cl.[5] ..... F26B 3/00

[52] U.S. Cl. ..... 34/23; 34/41; 34/122

[58] Field of Search ..... 34/113, 114, 115, 116, 34/117, 118, 23, 39, 40, 41, 111, 122, 123; 162/DIG. 7, 370

[56] References Cited

U.S. PATENT DOCUMENTS 4,513,516 4/1985 Bjornberg ..... 34/41

FOREIGN PATENT DOCUMENTS 136482 5/1964 France ..... 34/122

261636 9/1949 Switzerland ..... 34/122

*Primary Examiner*—Henry A. Bennet

*Assistant Examiner*—John Sollecito

*Attorney, Agent, or Firm*—Cohen, Pontani & Lieberman

[57] ABSTRACT

A method and apparatus for regulating the profile of a paper web passing over a Yankee cylinder in an integrated IR-dryer/Yankee hood (3,2), wherein the IR-dryer (3) is placed before the wet-end block of the Yankee cylinder. The amount of air leaking into the hood (2) through the gap between the hood (2) and the Yankee cylinder (1) is reduced by passing into this gap ($h_o$) cooling air (5) warmed up in the IR-dryer (3) and taken from said IR-dryer (3).

22 Claims, 3 Drawing Sheets

APPARATUS AND METHOD FOR REGULATING THE PROFILE OF A PAPER WEB PASSING OVER A YANKEE CYLINDER IN AN INTEGRATED IR-DRYER/YANKEE HOOD

FIELD OF THE INVENTION

The present invention relates to an apparatus and method for the regulation of the profile of a paper web in an integrated IR-dryer/Yankee hood, and particularly to a method and apparatus wherein the IR-dryer is placed before the wet-end block of a Yankee cylinder.

BACKGROUND OF THE INVENTION

For regulating the profile in a Yankee machine, an IR-dryer may be placed before the wet-end block of the hood, for example, so that the dryer becomes a part of the Yankee hood. For proper operation, the radiators of the IR-dryer must be cooled, which requires a certain amount of cooling air, whereby the ultimate temperature of the air rises to a level of about 80° C. to about 100° C.

Due to leakage of air and heat from the Yankee hood, the gap between the Yankee hood and the cylinder is a problematic and critical point. Penetration of very hot and moist air through the gap into the machine hall results in inferior working conditions and in higher consumption of energy. Also, when the leakage from the machine hall into the hood becomes excessive, the consumption of energy is additionally increased because the temperature of the circulation air and of the exhaust air is lowered.

It is generally difficult to regulate the leakage of air and heat because the plates obstructing the gap between the Yankee cylinder and hood do not operate efficiently. Since the air-conditioning of the hood is very difficult to regulate in a manner so that leakage is completely eliminated, small leakage from the machine hall into the hood is, as a rule, permitted because leakage into the hood is less detrimental than leakage in the outward direction. Therefore, there is generally a slight negative pressure in the gap between the Yankee cylinder and the hood, and the amount of leakage is, as a rule, from about 10 to about 15% of the exhaust air of the total block, which air is removed from the system.

SUMMARY OF THE INVENTION

It is accordingly one object of the present invention to obtain economies in the consumption of energy by preventing air leakage within the entire area of the Yankee cylinder from the machine hall into the hood, and whereby the temperature in the gap between the hood and the Yankee cylinder is maintained sufficiently high.

Accordingly, the method of the present invention is directed to reducing the amount of outside air leaking into the hood through the gap between the hood and the Yankee cylinder by passing into this gap cooling air from the IR-dryer which air has been previously warmed up in the IR-dryer.

The apparatus in accordance with the present invention comprises means by which cooling air warmed up in the IR-dryer and taken from said dryer is passed into the gap between the hood and the cylinder.

In an integrated IR-dryer/Yankee hood in accordance with the present invention, a row of nozzles is preferably provided along the outer edges of the Yankee hood and substantially parallel thereto. Cooling air warmed up in the IR-dryer and taken from said dryer is passed by means of these edge nozzles into the gap between the hood and the cylinder to essentially form an air curtain between the cylinder and the hood. The IR-dryer is placed in front of the wet end of the Yankee cylinder, either outside the Yankee hood or in a manner so that the dryer forms a part of the hood. Preferably, the row of edge nozzles is placed along the entire length of the hood outside the suction openings or exhaust pipes thereof through which the exhaust air is removed in known manner. The air velocity in the edge nozzles is relatively low, and the air is blown preferably directly against the Yankee cylinder. When we talk about "edge nozzles" we mean air openings provided in the Yankee hood located at both outer the edges thereof and preferably along the entire length thereof. Accordingly, edge nozzles are preferably provided in the hood both, at the service side and at the operation side thereof. The paper web passing over the Yankee cylinder does not extend all the way up to the edges of the cylinder thus leaving a small cylinder area uncovered against which the air is blown from the edge nozzles thereby preventing leakage of air and heat from and into the hood and along the entire paper web. The lateral air streams or flows are also important in view of maintaining suitable operation temperatures.

While part of the air may flow out through the gap into the machine hall, most of the air is directed into the hood.

As pointed out, the air is preferably blown directly against the Yankee cylinder. If the air curtain were directed inwards, it might draw along some cold air out of the machine hall. Thus, another object of the invention is that by means of gentle blowing substantially directly downward onto the Yankee cylinder, warm air is introduced into an area from which air flows into the hood.

BRIEF DESCRIPTION OF THE DRAWINGS

In the following, the invention will be described in detail with reference to the accompanying drawings which are supplied for illustrative purposes only and are not intended to restrict the scope of the invention.

DETAILED DESCRIPTION OF THE PRESENTLY PREFERRED EMBODIMENTS

Figure 1:
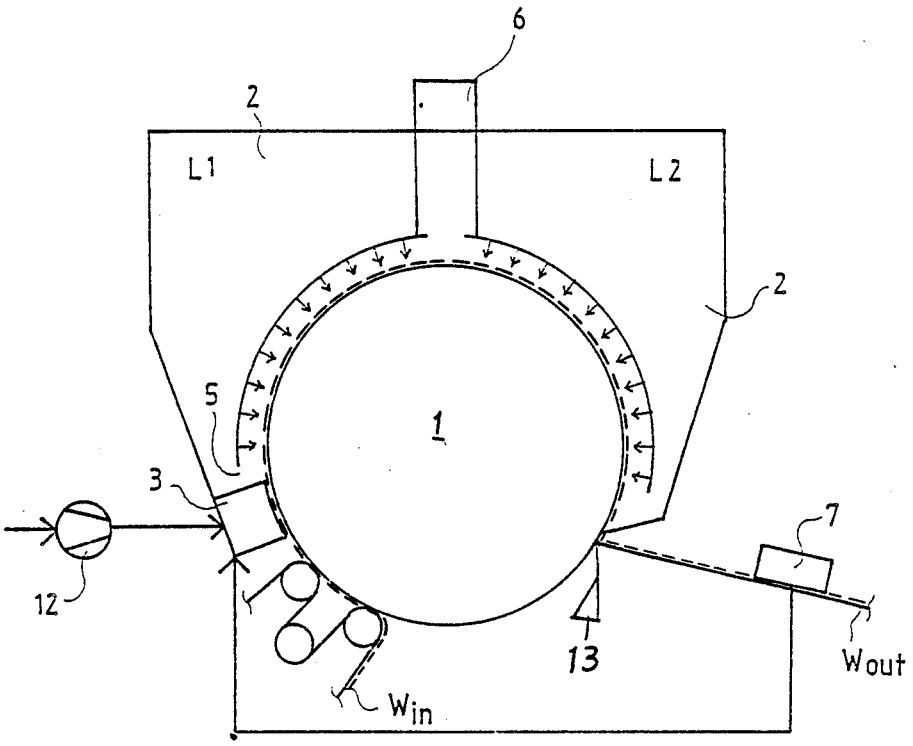
FIG. 1 is a schematic sectional view of an IR-dryer-/Yankee cylinder in accordance with the invention.
Figure 2:
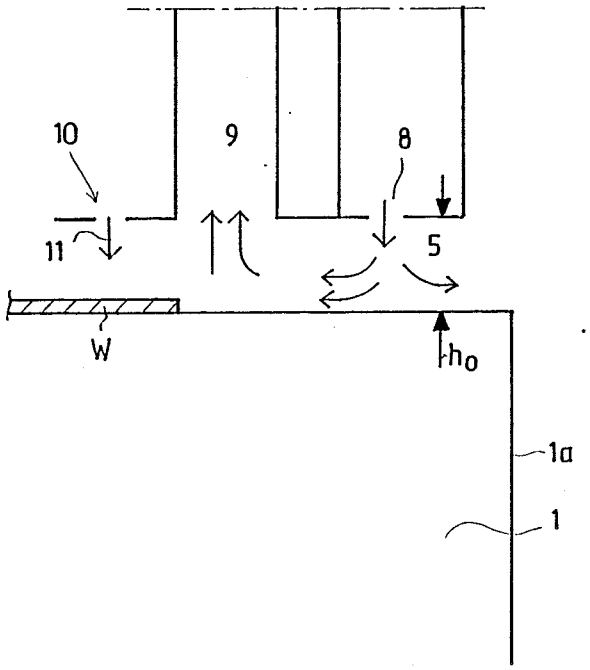
FIG. 2 is a partial schematic axial sectional view of a Yankee cylinder showing in detail the air streams applied thereto.

In FIG. 1, the Yankee cylinder is represented by the reference numeral 1, the hood placed over the cylinder with the reference numeral 2 and the IR-dryer with the reference numeral 3. According to FIG. 1, the air distribution system of the Yankee cylinder is divided into two parts, the wet-end block which is denoted with L1 and the dry-end block which is indicated with L2. The IR-dryer is preferably placed immediately before the wet-end block L1, so that it forms a part of the hood 2. Alternatively, the IR-dryer may also be placed outside the Yankee hood. The distributor pipe through which heated air is passed into the first and second block is denoted with the reference numeral 6. The incoming paper web is denoted with $W_{in}$, and is directed to run over the Yankee cylinder as indicated by the dotted line. The outgoing paper web $W_{out}$ is removed from the Yankee cylinder in known manner by a scraper or doctor-type element 13. The moisture profile of the outgoing paper web is measured by means of a measurement beam 7. Data obtained by measuring the moisture profile of the outgoing web are directed to IR-dryer 3 for the regulation and control thereof. The regular blow air which is blown against the Yankee cylinder 1 is indicated with reference numeral 11 (FIG. 2). The cooling air introduced into the IR-dryer is passed by means of the blower 12 into the IR-dryer 3. According to the invention, cooling air heated in the IR-dryer and removed therefrom is blown against the Yankee cylinder 1 by means of blowing nozzles 8 located preferably along the entire length of the hood 2 as will be described in more detail below. The air curtain is denoted with the reference numeral 5 and also indicated in FIG. 1 by a plurality of arrows extending from the Yankee hood towards the Yankee cylinder.

In FIG. 2, which is an axial sectional view of the Yankee cylinder 1, one end la of the Yankee cylinder 1 is shown. The paper web which does not extend all the way to the end 1*a* of the cylinder 1, is denoted with W. The edge nozzles, through which heated cooling air 5, taken from the IR-dryer and having a temperature of about 80° C. to about 100° C. is passed into the gap $h_o$ between the hood and the cylinder are denoted with the reference numeral 8. The size of the gap $h_o$ or distance between the Yankee hood and Yankee cylinder is about 20 mm. The velocity v of the air 5 blown through the edge nozzles 8 is relatively low, from about 3 to about 20 m/s, preferably about 5 m/s. The air 5 is blown preferably directly perpendicularly against the cylinder 1. At the hood 2, there are edge nozzles both at the service side and at the operation side. It is possible that part of the air flows out through the gap $h_o$ into the machine hall, but most of it passes into the hood 2 as indicated by the double arrows. FIG. 2 also shows the exhaust pipes 9, which permits the removal of both the regular drying-blow air 11 exiting from blow nozzles 10 onto the paper web and the edge-blow air 5 coming from edge nozzles 8 and forming the air curtain in gap $h_o$. The blow air 11 exiting from the blow nozzles 10 is blown towards the web W at a velocity of about $v_p \approx 100$ m/s.

Figure 3:
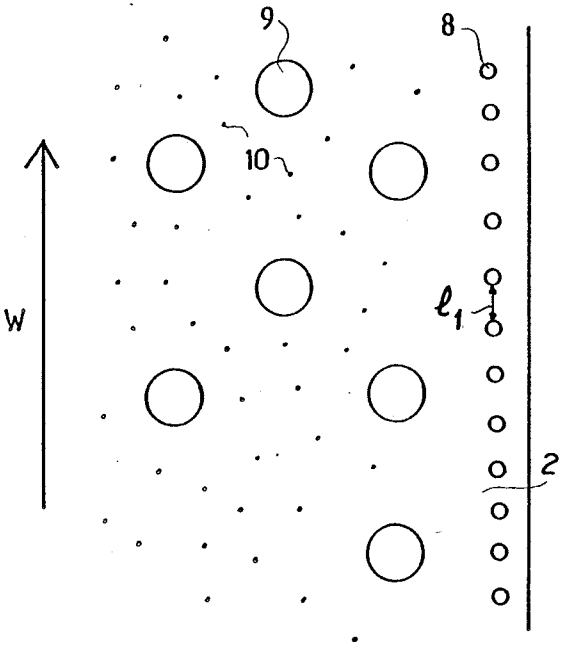
FIG. 3 is a schematic sectional view of the blow pipes directed at the Yankee cylinder.

FIG. 3, wherein one end of the hood 2 is shown, is a sectional view of air nozzles 8, exhaust pipes 9 and drying blow air openings 10. The diameter of the edge nozzles 8, which are preferably placed in a line along the entire length of the hood and outside the area in which the exhaust pipes 9 and blow-air openings 10 are located, is $\phi_2$=about 5 . . . 20 mm, preferably about 10 . . . 15 mm, and their distance $l_2$ from each other is about 50 . . . 200 mm, preferably about 100 mm. The diameter $\phi_1$ of the exhaust pipes 9 is, e.g. about 60 mm, and the diameter $\phi_2$ of the blow air nozzles 10 is, e.g., about 5 mm. The running direction of the paper web W is shown by an arrow in FIG. 3.

Figure 4:
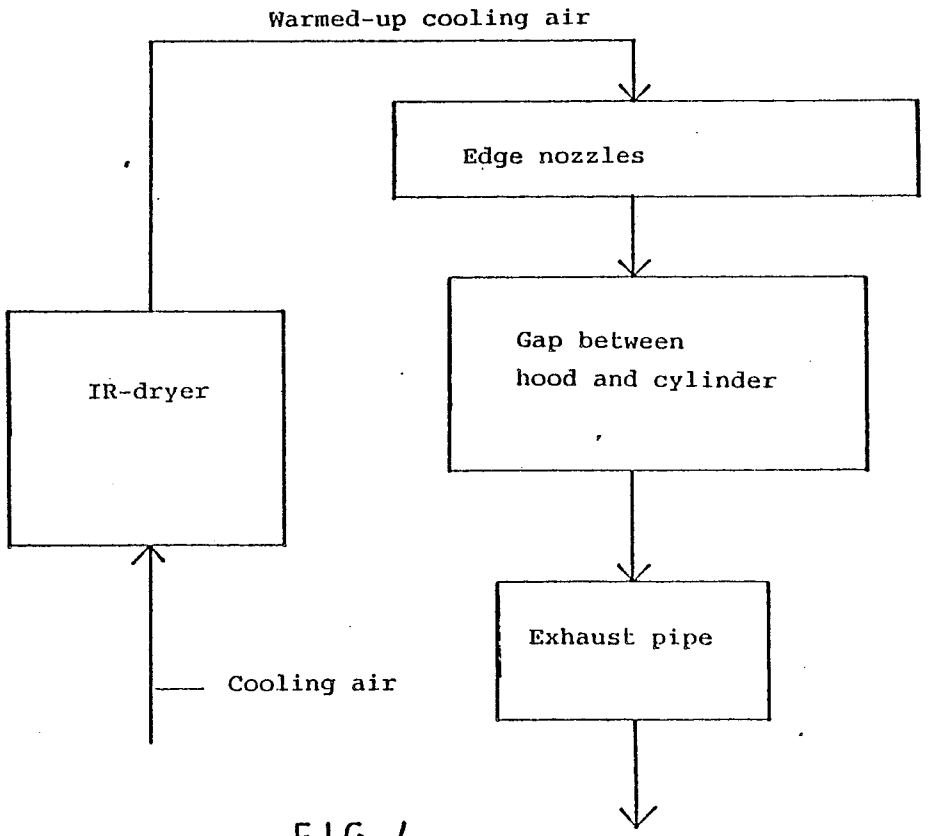
FIG. 4 shows the circulation of the cooling air of an IR-dryer as a block diagram.

FIG. 4 is a schematic representation of the air circulation path in the method and apparatus of the present invention. Accordingly, cooling air is first introduced into the IR-dryer and heated therein. Heated cooling air withdrawn from the IR-dryer is then passed through distributor pipe 6 into both blocks of the Yankee-hood and blown against the Yankee-cylinder through edge nozzles 8. While some of the air blown into the gap between the Yankee hood and the cylinder will pass into the machine hall, most of the air forming the air curtain between the Yankee hood and the cylinder will be directed into the hood and exhausted therefrom through exhaust pipes 9.

Since this as well as further embodiments and modifications thereto are intended to be within the scope of the present invention, the above description should be construed as illustrative and not in a limiting sense, the scope of the invention being defined only by the following claims.

What is claimed is:

1. A method of regulating the profile of a paper web passing over a Yankee cylinder in an integrated IR-dryer Yankee hood having lateral end portions and a gap between the hood and the cylinder and through which an amount of outside air is leaking into said hood, said method comprising:

introducing cooling air into said IR-dryer;

heating said air in said dryer;

removing heated air from said dryer and passing said air to said end portions of said Yankee hood; and directing said heated air at said end portions into the gap formed between said hood and said Yankee cylinder for reducing the amount of outside air leaking into said hood through said gap.

2. The method as claimed in claim 1, wherein the cooling air from the IR-dryer is passed into the gap between the hood and the Yankee cylinder by means of edge nozzles.

3. The method as claimed in claim 2, wherein said edge nozzles are located outside the suction openings and substantially along the entire length of said hood.

4. The method as claimed in claim 2, wherein the air velocity in said edge nozzles is from about 3 m/s to about 20 m/s.

5. The method as claimed in claim 2, wherein the air velocity in said edge nozzles is about 5 m/s.

6. The method as claimed in claim 2, wherein said hood has a serial side and an operation side said edge nozzles are located both at the service side and at the operation side of said hood.

7. The method as claimed in claim 1, wherein the air is directed substantially perpendicularly toward said cylinder.

8. An apparatus for regulating the profile of a paper web comprising in combination:

a Yankee cylinder;

a Yankee hood substantially enclosing at least part of said cylinder and defining a wet-end block and a dry-end block therein, said Yankee cylinder and Yankee hood having end portions and forming a gap therebetween;

an air cooled IR-dryer located in front of said wet end block of said hood; and means at said end portions for passing air from said IR-dryer to said gap formed between said hood and said Yankee cylinder so as to reduce outside air from leaking into said gap.

9. The apparatus of claim 8, wherein said air is cooling air from said IR-dryer.

10. The apparatus of claim 8, wherein the IR-dryer is located in front of said wet-end block of said hood so that it forms a part of said hood.

11. The apparatus of claim 8, wherein the IR-dryer is located in front of said wet-end block of said hood outside said Yankee hood.

12. The apparatus of claim 8, wherein said means for passing air from said IR-dryer into said gap between said hood and said Yankee cylinder comprise edge nozzles.

13. The apparatus of claim 8, wherein said hood has a length and additionally comprises suction openings and wherein said means for passing air from said IR-dryer into said gap between said hood and said Yankee cylinder is placed outside said suction openings substantially along the entire length of said hood.

14. The apparatus of claim 8, wherein said hood has a service side and an operation side and wherein said means for passing air from said IR-dryer into said gap between said hood and said Yankee cylinder is placed both at said service side and said operation side.

15. The apparatus of claim 8, wherein said means for passing air from said IR-dryer into said gap between said hood and said Yankee cylinder has a diameter measuring from about 5 to about 20 mm.

16. The apparatus of claim 8, wherein the diameter of said means for passing air from said IR-dryer into said gap between said hood and said Yankee cylinder is from about 10 to about 15 mm.

17. The apparatus of claim 8, wherein the distance between the means for passing air from said IR-dryer into said gap between said hood and said Yankee cylinder is from about 50 mm to about 200 mm.

18. The apparatus of claim 8, wherein the distance between the means for passing air from said IR-dryer into said gap between said hood and said Yankee cylinder is from about 50 mm to about 100 mm.

19. The apparatus of claim 12, additionally comprising suction openings in said hood and wherein said edge nozzles are located outside the area of said suction openings and substantially along the entire length of said hood.

20. The apparatus of claim 12, wherein said hood has a service side and an operation side and wherein said edge nozzles are located both at said service side and said operation side.

21. The apparatus of claim 12, wherein the diameter of said edge nozzles is from about 5 to about 20 mm.

22. The apparatus of claim 12, wherein said edge nozzles are placed at a distance from each other of about 50 mm to about 200 mm.

* * * * *